United States Patent [19]

Oxley et al.

[11] Patent Number: 4,894,875

[45] Date of Patent: Jan. 23, 1990

[54] SINK MAT ORGANIZATION

[76] Inventors: Jack B. Oxley; Joel T. Oxley, both of Star Rte. Box 145, Hico, W. Va. 25854

[21] Appl. No.: 279,515

[22] Filed: Dec. 5, 1988

[51] Int. Cl.[4] ..... A47K 00/00; E03C 00/00

[52] U.S. Cl. ..... 4/657; 4/581; 4/DIG. 18

[58] Field of Search ..... 4/DIG. 18, 651, 661, 4/577

[56] References Cited

U.S. PATENT DOCUMENTS

| | | | |
|---|---|---|---|
| D. 186,708 | 11/1959 | Bliss . | |
| D. 193,089 | 6/1962 | Kraines . | |
| 2,217,821 | 10/1940 | Shiner | 4/577 |
| 2,284,494 | 5/1942 | Oakley | 4/657 |
| 2,596,735 | 5/1952 | Suarez | 4/657 |
| 4,512,044 | 4/1985 | Clark | 4/581 |

FOREIGN PATENT DOCUMENTS

| | | | |
|---|---|---|---|
| 3028661 | 2/1982 | Fed. Rep. of Germany | 4/DIG. 18 |

*Primary Examiner*—Henry K. Artis
*Attorney, Agent, or Firm*—Leon Gilden

[57] ABSTRACT

A sink mat is set forth wherein the mat is of a generally rectangular configuration formed of laminated polymeric layers. The layers are mechanically or adhesively secured together to capture coil springs therein. THe coil springs are formed in a plurality of circular patterns originating from the center of the mat to cushion and absorb impact when positioned. Furthermore, a plurality of bendable elongate wires are captured within spaced peripheral positions within the laminated layers to enable deformation and recontouring of the mat to accommodate variations in associated sink contours.

1 Claim, 1 Drawing Sheet

SINK MAT ORGANIZATION

BACKGROUND OF THE INVENTION

1. Field of the Invention

The field of the invention pertains to sink mats, and more particularly pertains to a new and improved sink mat organization provided with shock absorbing members captured therein and a deformable configuration adaptable to various sink contours.

2. Description of the Prior Art

The use of sink mats is old and well known in the prior art. Sink mats of the past have generally been of various configurations to conform to a particular sink depression surface and have absorbed impact by dishes and the like falling thereon by the inherent thickness of the mats themselves. For example, sink mats of the prior art have been relegated to design configurations and may be found U.S. Pat. No. Des. 186,708 to Bliss illustrating a mesh-like pattern formed with an ornamental peripheral configuration.

U.S. Pat. No. Des. 187,856 to Timmons is set forth as a further example of a sink mat with a central pivotal door opening and a ribbed surface organization.

U.S. Pat. No. Des. 193,089 to Kraines, et al., sets forth a further example of a sink mat formed with a series of concentric ribs and raised radial ribs emanating from the center of the mat.

U.S. Pat. No. Des. 193,090 to Kraines sets forth a further sink mat organization differing in the configuration of the circular rib pattern, and U.S. Pat. No. Des. 199,838 to Hack sets forth a pad formed with a smooth surface and an underlying rib surface ostensibly for frictional enhancing purposes, but will inherently effect shock absorbency of the mat in use.

As such, it may be appreciated that there is a continuing need for a new and improved sink mat organization wherein the same provides for molding of the sink mat to conform to various sink surfaces, and including associated shock absorbing means therein to accommodate impact upon the surface of the mat; and in this respect, the present invention substantially fulfills this need.

SUMMARY OF THE INVENTION

In view of the foregoing disadvantages inherent in the known types of sink mats now present in the prior art, the present invention provides a sink mat wherein the same enables conforming of the mat to various contoured support surfaces and further includes a plural series of shock absorbing members captured within laminates of the sink mat of the instant invention. As such, the general purpose of the present invention, which will be described subsequently in greater detail, is to provide a new and improved sink mat organizations which has all the advantages of the prior art sink mats and none of the disadvantages.

To attain this, the present invention includes a plurality of laminated sink mat layers provided with surface ribs thereon for frictional retention of the mat in contact with a support surface and further includes a plurality of elongate deformable rods of continuous construction captured within the laminates of the mat to enable manual manipulation of the mat to conform to various contoured support surfaces. Further, the mat includes a plurality of captured springs formed in circular patterns about a center of the mat to enhance shock absorption qualities of the mat.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sink mat which has all the advantages of the prior art sink mats and none of the disadvantages.

It is another object of the present invention to provide a new and improved sink mat which may be easily and efficiently manufactured and marketed.

It is a further object of the present invention to provide a new and improved sink mat which is of a durable and reliable construction.

An even further object of the present invention is to provide a new and improved sink mat which is susceptible of a low cost of manufacture with regard to both materials and labor, and which accordingly is then susceptible of low prices of sale to the consuming public, thereby making such sink mats economically available to the buying public.

Still yet another object of the present invention is to provide a new and improved sink mat which provides in the apparatuses and methods of the prior art some of the advantages thereof, while simultaneously overcoming some of the disadvantages normally associated therewith.

Still another object of the present invention is to provide a new and improved sink mat wherein the same enables conformity to various support surfaces and further utilizes a series of shock absorbing members captured within the mat to enhance shock absorption qualities of the mat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
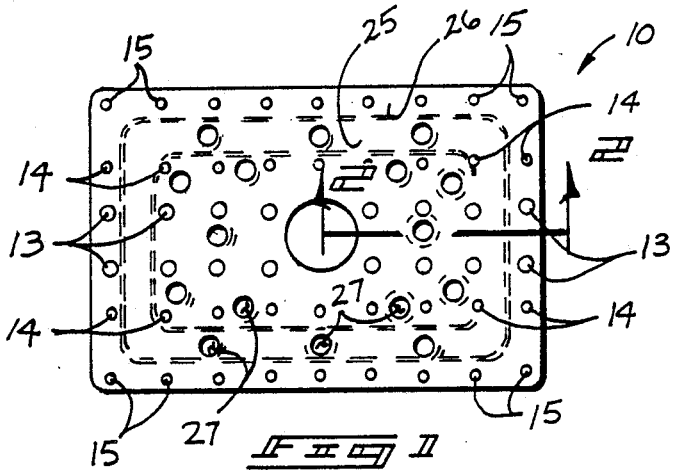
FIG. 1 is a top orthographic view of the instant invention.
Figure 2:
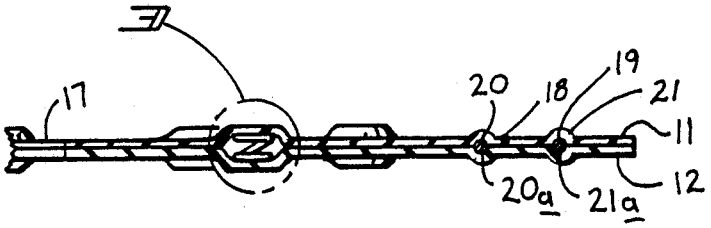
FIG. 2 is an orthographic view taken along the lines 2—2 of FIG. 1 in the direction indicated by the arrows.
Figure 3:
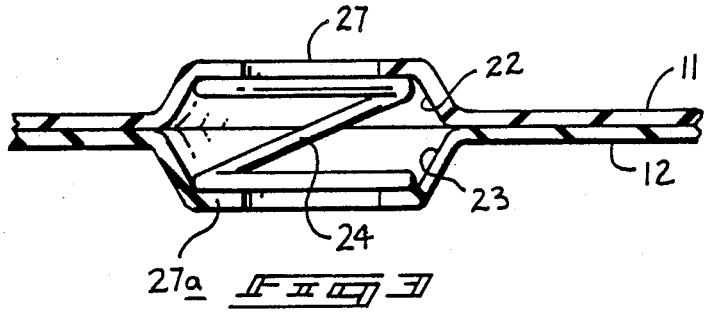
FIG. 3 is an enlarged sectional view of segment 3, as illustrated in FIG. 2.

With reference now to the drawings, and in particular to FIGS. 1 to 3 thereof, a new and improved sink mat organization embodying the principles and concepts of the present invention and generally designated by the reference numeral 10 will be described.

More specifically, the sink mat organization 10 essentially comprises a first upper laminate 11 secured to a second laminate 12 in a face to face relationship, as illustrated in FIG. 2 for example, with a plurality of through-extending first openings 13 of a first diameter arranged in parallel rows with a plurality of second openings 14 of a second diameter less than the first diameter openings 13 and a further plurality of rows positioned exteriorly of the rows of first openings 13. Further, plural rows of third openings 15 of a diameter less than that of the second openings 14 are arranged in parallel rows exteriorly of the rows of second openings 14. Water collecting within a sink cavity will thereby proceed to drain through the first openings 13 at a greater rate than through the second openings 14 which would drain water at a greater rate than the third openings 15 to direct such water towards the central drain opening 17 aligned with a conventional sink drain. The first and second laminates 11 and 12 are formed of a polymeric flexible material and may be mechanically joined together or adhesively secured together in the face to face relationship to create an unitary organization.

A plurality of continuous rods comprising a first intercontinuous rod 18 extending generally parallel to the peripheral edges of the sink mat 10 and a second outwardly spaced inward continuous rod 19 are captured within the laminates 11 and 12. The continuous rods 18 and 19 are parallel to one another and are formed of a malleable memory retentent material that will retain its shape upon deformation to thereby enable the sink mat to conform to variations in sink contours and sizes by enabling the mat to retain a configuration upon deformation of the rods 18 and 19 respectively. The first continuous rod 18 is captured within the laminates 11 and 12 in a parallel relationship to the second continuous rod 19 and wherein both rods are parallel to the peripheral edge of the mat 10. The first rod 18 is captured between the first and second laminates 11 and 12 in respective continuous semi-circular channels 20 and **20*a* formed continuously within the laminates 11 and 12. Accordingly, the second continuous rod 19 is captured within the respective third and fourth continuous semi-circular channels 21 and 21*a***.

Cup shaped recesses are formed within the respective first and second laminates 11 and 12 and project orthogonally outwardly of the laminates and include respective first and second cup-shaped recesses 22 and 23 to form compartments to capture a respective coil spring 24 within each of the cup-shaped projections 27. The projections 27 and **27*a* formed in the respective laminates 11 and 12 respectively project exteriorly of the surfaces of the laminates 11 and 12, as noted, to thereby provide a raised surface area to enhance drainage through the aforenoted openings 13, 14, and 15. The projections 27 and 27*a* are formed in a circular array defining a first circular array 25 and a diametrically larger second circular array 26. The projections therefore provide the dual function of providing drainage access from the various openings 13, 14, and 15 and further enables the sink mat organization 10** to accommodate impact from various items accommodated within a sink, such as glassware and the like, to minimize breakage of such items.

It is believed the instant invention affords a unique accommodation of various sink contours by manipulating the continuous rods 18 and 19 to deform the sink mat organization 10 to enable the sink mat to be positionable within a variety of sink sizes and shapes. Further, the shock absorbing spring members 24 enable the sink mat 10 to accommodate impact from various frangible items, such as glassware and the like, minimizing damage to such glassware and elimination of the danger of fragments resulting from breakage of such items.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sink mat for accommodation of a variety of sink sizes and contours comprising, a flexible pad including an upper surface and a parallel lower surface, and a through-extending central opening in said pad to overlie a fluid rate in said sink, and at least one continuous channel formed parallel to a continuous terminal edge of said pad, and an elongate deformable rod captured in said channel, and wherein said deformable rod is formed of memory retentent material to retain a predetermined configuration subsequent to manipulation of said rod to said configuration, and wherein said pad comprises an upper and lower flexible laminate secured together to form said channel wherein said channel includes a semi-circular channel formed in each confronting surface of said upper and lower laminant and of complementary semi-circular configuration to define a circular conduit to capture said rod, and further including a plurality of cup-shaped recesses formed in said upper and lower laminate of complementary configuration to define a cell wherein said cell includes a resilient member captured therewithin to provide impact resistance to said pad, and wherein each of said cells are formed in a plurality of arrays wherein said arrays include a first circular array formed about said central opening, and further including a second circular array spaced outwardly of said first array about said central opening, and further including plural rows of first openings formed centrally along said mat, and plural rows of second openings of lesser diameter than said first openings formed exterior of said said second openings positioned outwardly of said second openings and said terminal edge of said mat.

* * * * *